US010408570B2

(12) United States Patent
Toole

(10) Patent No.: US 10,408,570 B2
(45) Date of Patent: Sep. 10, 2019

(54) SIDE RECEIVING MOUNTED LASER AIMING AND ILLUMINATION DEVICE FOR FIREARMS

(71) Applicant: CQB OPTICS, LLC, Oregon City, OR (US)

(72) Inventor: Ronald L. Toole, Oregon City, OR (US)

(73) Assignee: CQB OPTICS, LLC, Oregon City, OR (US)

( * ) Notice: Subject to any disclaimer, the term of this patent is extended or adjusted under 35 U.S.C. 154(b) by 0 days.

(21) Appl. No.: 15/875,196

(22) Filed: Jan. 19, 2018

(65) Prior Publication Data

US 2019/0226804 A1 Jul. 25, 2019

(51) Int. Cl.

| | |
|---|---|
| ***F41G 1/35*** | (2006.01) |
| ***F41G 11/00*** | (2006.01) |
| ***F41G 1/36*** | (2006.01) |

(52) U.S. Cl.

CPC ..... *F41G 1/35* (2013.01); *F41G 1/36* (2013.01); *F41G 11/001* (2013.01); *F41G 11/003* (2013.01)

(58) Field of Classification Search

CPC . F41G 1/35; F41G 1/36; F41G 11/001; F41G 11/003

USPC ..... 42/114, 115, 117

See application file for complete search history.

(56) References Cited

U.S. PATENT DOCUMENTS

| | | | |
|---|---|---|---|
| 5,064,988 | A | 11/1991 | E'nama et al. |
| 5,068,969 | A | 12/1991 | Siebert |
| 5,176,235 | A | 1/1993 | Toole |
| 5,584,137 | A | 12/1996 | Teetzel |

(Continued)

FOREIGN PATENT DOCUMENTS

EP 2722632 A2 4/2014

*Primary Examiner* — Bret Hayes

(74) *Attorney, Agent, or Firm* — Miller Nash Graham & Dunn LLP

(57) ABSTRACT

A laser aiming and illumination device configured to be mounted onto a firearm such that mounting the device onto the firearm does not require permanent alteration of the firearm, the firearm having a trigger, a grip, a lower portion and an upper portion having a side surface. The laser aiming and illumination device includes an illumination module, including at least one of an illumination source and a laser source mounted to the side surface, an illumination mode selector configured to select an operating mode of the at least one of the illumination source and the laser source, a power module including a power source inside the grip, the power module electrically connected to the illumination module, an activation switch disposed adjacent the trigger of the firearm and configured to operate the at least one of the illumination source and the laser source in the selected operating mode. One embodiment has a lower connector attached to the lower portion and electrically connected to the power source in the grip, and an upper connector on the illumination module to releasably mate with the lower connector and to provide power connection to the illumination module such that when the lower connector and the upper connector are mated, the power connection is protected from an external environment. Another embodiment has the power source and the accessory co-located in the same housing.

9 Claims, 15 Drawing Sheets

(56) References Cited

U.S. PATENT DOCUMENTS

| | | | | |
|---|---|---|---|---|
| 5,822,905 | A | 10/1998 | Teetzel | |
| 6,163,131 | A | 12/2000 | Gartstein et al. | |
| 6,622,416 | B2 | 9/2003 | Kim | |
| 6,785,997 | B2 | 9/2004 | Oz | |
| 7,627,975 | B1 | 12/2009 | Hines | |
| 7,866,083 | B2 | 1/2011 | Teetzel | |
| 8,093,992 | B2 | 1/2012 | Jancic | |
| 8,225,542 | B2 | 7/2012 | Houde-Walter | |
| 8,607,492 | B2 | 12/2013 | Hartley et al. | |
| 9,766,038 | B2 * | 9/2017 | Toole | F41G 1/35 |
| 2008/0134562 | A1 | 6/2008 | Teetzel | |
| 2008/0216378 | A1 | 9/2008 | Murello | |
| 2009/0101776 | A1 * | 4/2009 | Peterson | F41G 11/001 248/205.1 |
| 2009/0277069 | A1 * | 11/2009 | Delmonico | F41C 27/00 42/105 |
| 2010/0091485 | A1 | 4/2010 | Matthews et al. | |
| 2010/0192443 | A1 | 8/2010 | Cabahug et al. | |
| 2010/0192444 | A1 | 8/2010 | Cabahug et al. | |
| 2010/0192448 | A1 | 8/2010 | Darian | |
| 2010/0218410 | A1 | 9/2010 | Cabahug et al. | |
| 2011/0000120 | A1 | 1/2011 | Thompson | |
| 2011/0283585 | A1 | 11/2011 | Cabahug et al. | |
| 2012/0131840 | A1 | 5/2012 | Toole | |
| 2012/0144716 | A1 | 6/2012 | Cabahug et al. | |
| 2013/0047482 | A1 | 2/2013 | Mulfinger | |
| 2013/0061504 | A1 | 5/2013 | Malherbe et al. | |
| 2013/0185978 | A1 | 7/2013 | Dodd et al. | |
| 2013/0194769 | A1 * | 8/2013 | Belack | F41G 11/003 361/807 |
| 2014/0130392 | A1 | 5/2014 | Oh et al. | |
| 2014/0317988 | A1 | 10/2014 | Baths et al. | |
| 2015/0020427 | A1 | 1/2015 | Compton et al. | |
| 2016/0209169 | A1 | 7/2016 | Toole | |

* cited by examiner

SIDE RECEIVING MOUNTED LASER AIMING AND ILLUMINATION DEVICE FOR FIREARMS

BACKGROUND

The AK-47 rifle, tactical shotgun and recently introduced shot shell firearm, such as those produced by Remington® and Mossberg® are popular firearms, but have limited options for laser and light accessories. They do not have an upper rail system, or only have available poor-quality, after-market accessories known to rapidly lose zero.

Another issue arises because the few good options available require mounting to the front portion of the firearm, requiring both hands on the firearm to perform two functions while attempting to accomplish one task. The user must use one hand to hold the fore grip of the firearm and the other to activate the accessory, with neither hand in the ready position to fire.

In some instances, a firearm may have a wire and bladder switch applied with duct tape or electrical wire ties to allow locating the activation switch near the firing hand. However, this causes a potential snag point and exposes the wire and electrical path to possible damage, deactivating the accessory.

As used here, the term "AK" refers to rifles based upon the original AK-47, or AK. The term "AK" comes from Avtomat Kalashnikova, which means essentially 'Kalashnikov's Automatic Rifle,' named for Mikhail Kalashnikov who invented the rifle. It is a gas-operated 7.62×39 mm assault rifle. The name "AK" has become a standard type of firearm, now manufactured by multiple companies across the world.

One of the most popular laser, light or laser/light combination accessories is a self-contained carrier that includes the illumination/laser element(s) and can be affixed to a standard top of receiver picatinny accessory rail of the firearm. These self-contained units contain the power source for the illumination/laser elements and the various associated switch and electrical circuitry to control functioning of the illumination/laser elements.

To select an operating mode of the illumination/laser element(s), the operator often must manipulate the firearm into an un-ready position to access the device to select a desired operating mode or to activate the device. Once the operator has selected the desired operating mode or activated the device, the operator can then reshoulder, or manipulate, the firearm into a ready position. Having the firearm in an un-ready position makes the operator vulnerable and unable to respond quickly and/or accurately to threats that may arise. Additionally, the activation of the illumination/laser element(s) prior to hostile engagement can reveal the operator's location, negating any stealth, or surprise the operator may have had.

One approach that solves these issues is shown in U.S. Pat. No. 9,766,038, "LASER AIMING AND ILLUMINATION DEVICE FOR AR-15 STYLE WEAPONS PLATFORM," for top-rail firearms on which the modules are mounted to a rail attached to the upper portion of AR-15 type firearms. However, the firearms described above do not have an upper rail, nor the ability to install an upper rail. Those available will lose their zero after several shots or when removed for cleaning and replaced rendering them useless. The accessories as mentioned require two hands or exposed wires to operate.

There exists a need for a device that integrates a laser and/or light source into a singular package for firearms with side receivers as described. Devices that have protected wires, can be activated single-handedly while allowing the user to maintain the firearm in a ready position or accurately direct the firearm from an unready position.

DETAILED DESCRIPTION

The issues resulting from the lack of a top rail for AK rifles, shot guns and shot shell firearms make them perfect candidates for a side receiver mounted system which will be mounted using a side receiver rail or high strength pins and screws to replace factory pins and screws, allowing one standard model to be mounted to the variety of receivers of each manufacturer. These can be user-installed with no modification to the factory zero when removed and replaced.

The embodiments here consist of a laser aiming and illumination device mountable to a side of a receiver or side accessory rail of a firearm. These firearms may include the various manufacturers' versions of the AK, and shot shell firearms. A shot shell firearm as used here means any firearm capable of using shot shells as ammunition. These may include shotguns and what are referred to as 'tacticals.' This last class may include such firearms as the TAC-14 and 12GA, such as those manufactured by Remington and Mossberg. They have a similar configuration as shotguns with a pump handle, but may not actually classified as shotguns. They typically do not include a shoulder stock, having instead a hand grip sometimes referred to as a 'duck's head' as the curvature of the profile looks like a duck head.

The AR-15 platform has two pieces that are held together with a pivot pin and locked with a takedown pin. The separation of the two pieces required the separation of the battery pack and the laser aiming and illumination module of the laser aiming and illumination device across a breakable connection. Unlike the AR-15, the AK and shot shell embodiments will have either the laser aiming and illumination device on a side mount, with the battery in the handgrip, or will have a co-located battery pack in the same housing. This requires a different architecture, wiring and connections.

Figure 1:
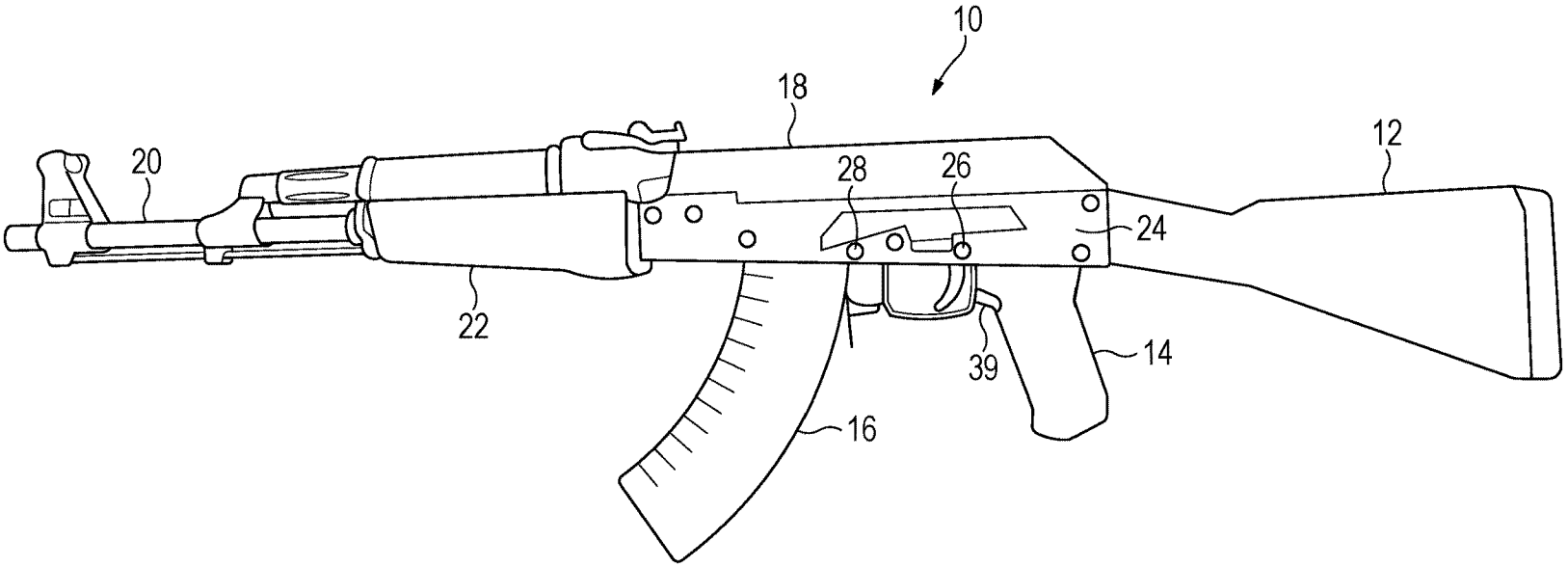
FIG. 1 shows an embodiment of an AK style rifle.

FIG. 1 shows an embodiment of an AK style rifle 10. The rifle has a shoulder stock 12, a handgrip 14, an optional magazine 16, and upper portion of the firearm 18, a front grip 22 and a barrel 20. This discussion will refer to the firearm as having a grip such as 14 and an upper portion 18, where the upper portion includes all portions of the firearm besides the handgrip, or grip, 14 and shoulder stock 12. The upper portion 18 has a side surface 24, with a trigger pin 26 and a hammer pin 28. The distances between these pins are typically standard among AK style rifles. This allows for standardized attachments for either a side rail to which the laser aiming and illumination device can attach, or a directly attached laser aiming and illumination device.

As used here, a 'laser aiming and illumination device' includes a 'laser aiming and illumination module' that in turn contains the actual lasers and illumination sources used to illuminate the targets. The laser aiming and illumination device may also include a power module, including a power source, electrical connectors to ensure power can reach the laser aiming and illumination module, an activation switch, and a mode switch.

An activation switch such as 39 will reside next to the trigger in a location such that the user will not have to move the trigger hand from the hand grip to activate the laser aiming and illumination module. This location may vary slightly from one embodiment to another for the different side-mount firearms discussed here, but the activation switch will reside adjacent the trigger. The mode switch may reside on the laser aiming and illumination module itself, as will be discussed in more detail later.

Figure 2:
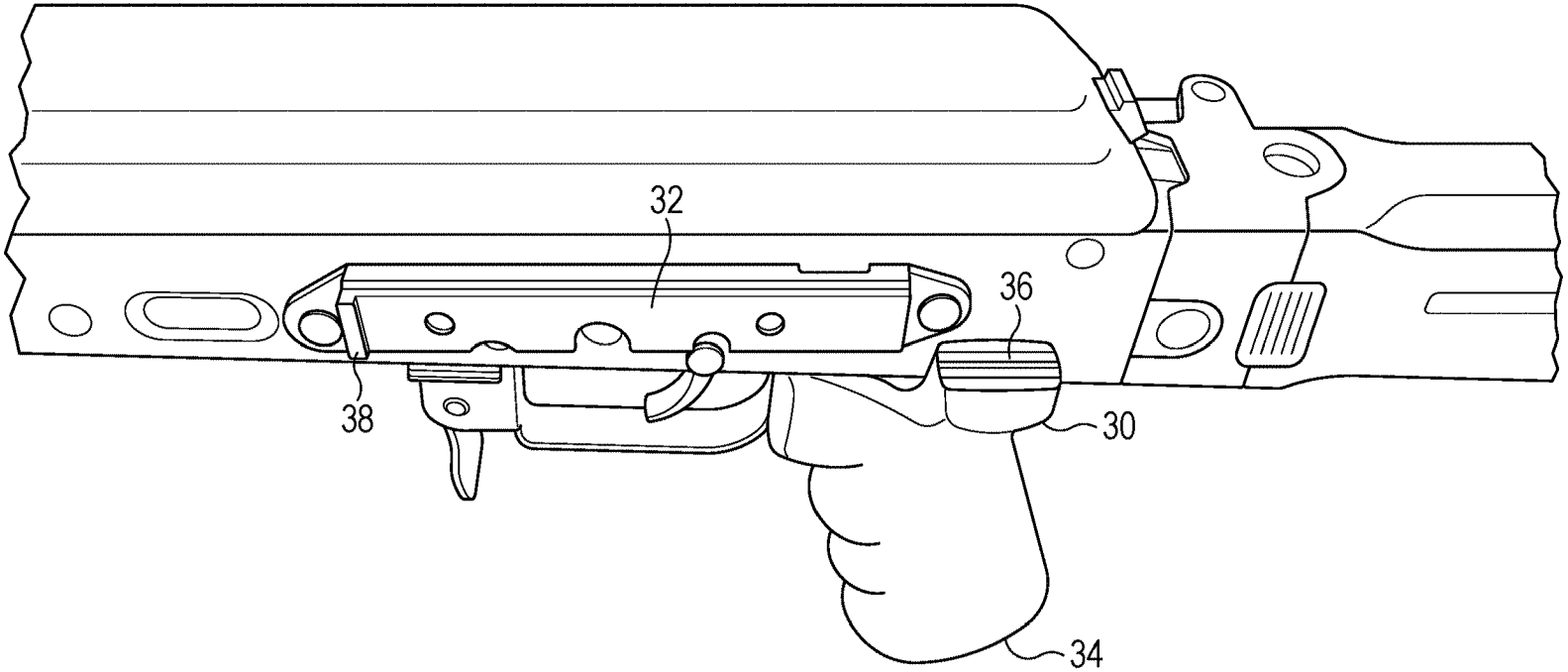
FIG. 2 shows an embodiment of an AK style rifle having a modified handgrip to include a power module.

FIG. 2 shows an AK style rifle modified to have a different hand grip 34 in which at least a portion of a power module resides. One should note that the modifications made to mount any of the embodiments of the laser aiming and illumination devices, including those made for the power module, the laser aiming and illumination module, the hand grip and the side rail or side mount are not permanent and can be easily reversed to return the firearm back to its original configuration.

In FIG. 2, the handgrip 34 includes a power source, discussed in more detail later. The handgrip includes a lower connector 30 that provides an electrical connection between the power source and the laser aiming and illumination module to provide power to the laser aiming and illumination module when the lower connection is mated to the upper connector, shown later. The modification may include a side rail of the firearm 10. In some instances, when the firearm does not have a side rail, the laser aiming and illumination device may include one. The side rail 32 may include a stop 38 that prevents the laser aiming and illumination device from sliding too far towards the barrel of the firearm. This prevents the laser aiming and illumination device from interfering with the operation of the firearm.

Figure 3:
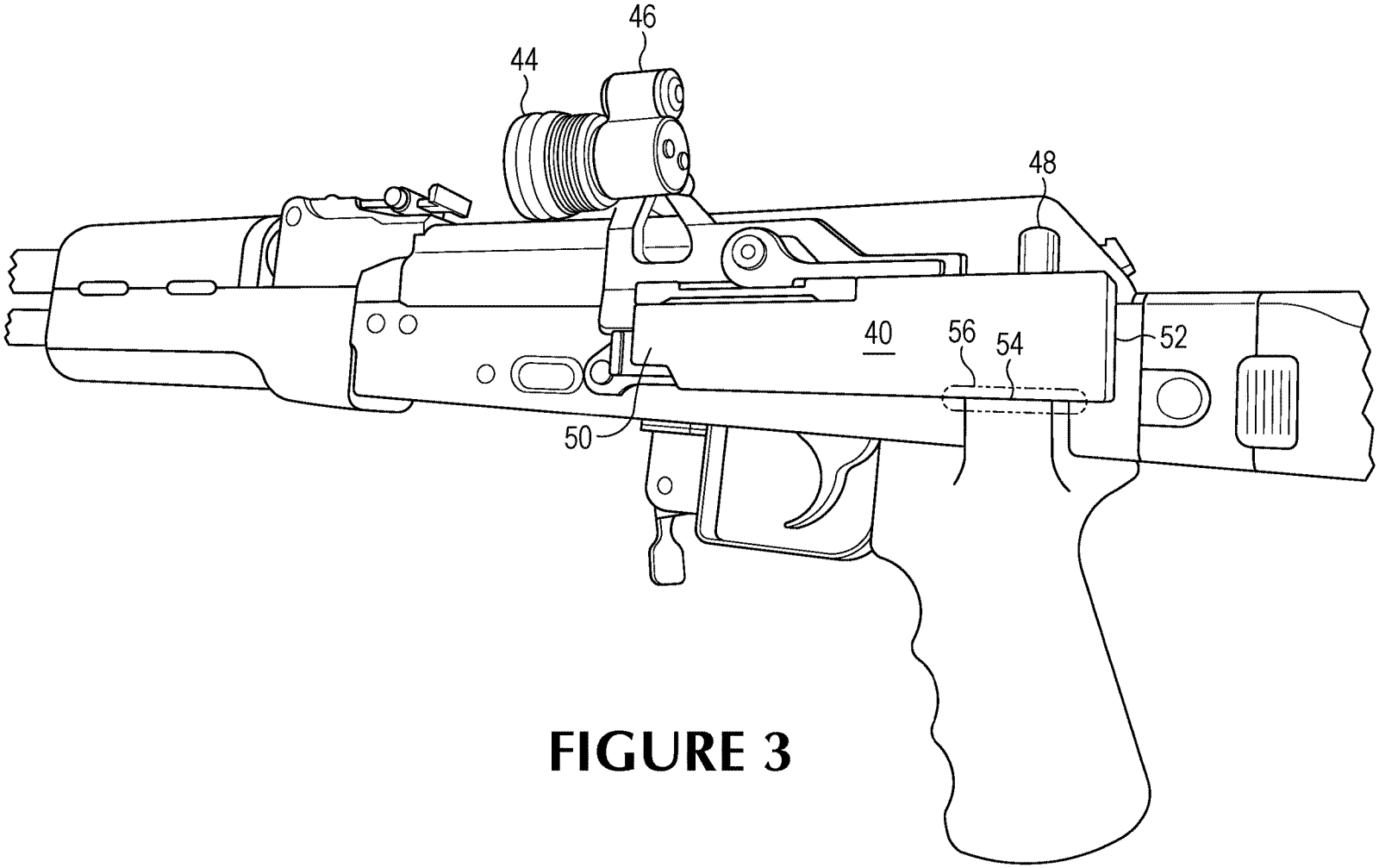
FIG. 3 shows a side view of an embodiment of an AK style rifle with a mounted laser aiming and illumination device.

FIG. 3 shows an embodiment of an AK style rifle having a laser illumination device 40 mounted to the side rail. Not shown on the laser aiming and illumination module shown is an upper connector 54 that mates to the lower connector 30 such that when the two connectors are mated, the power connection 56 between the power source and the laser aiming and illumination module remains protected from the external environment. The upper and lower connectors may take the form of pogo-pin type connectors, or electrical contact rails between the two devices.

Figure 4:
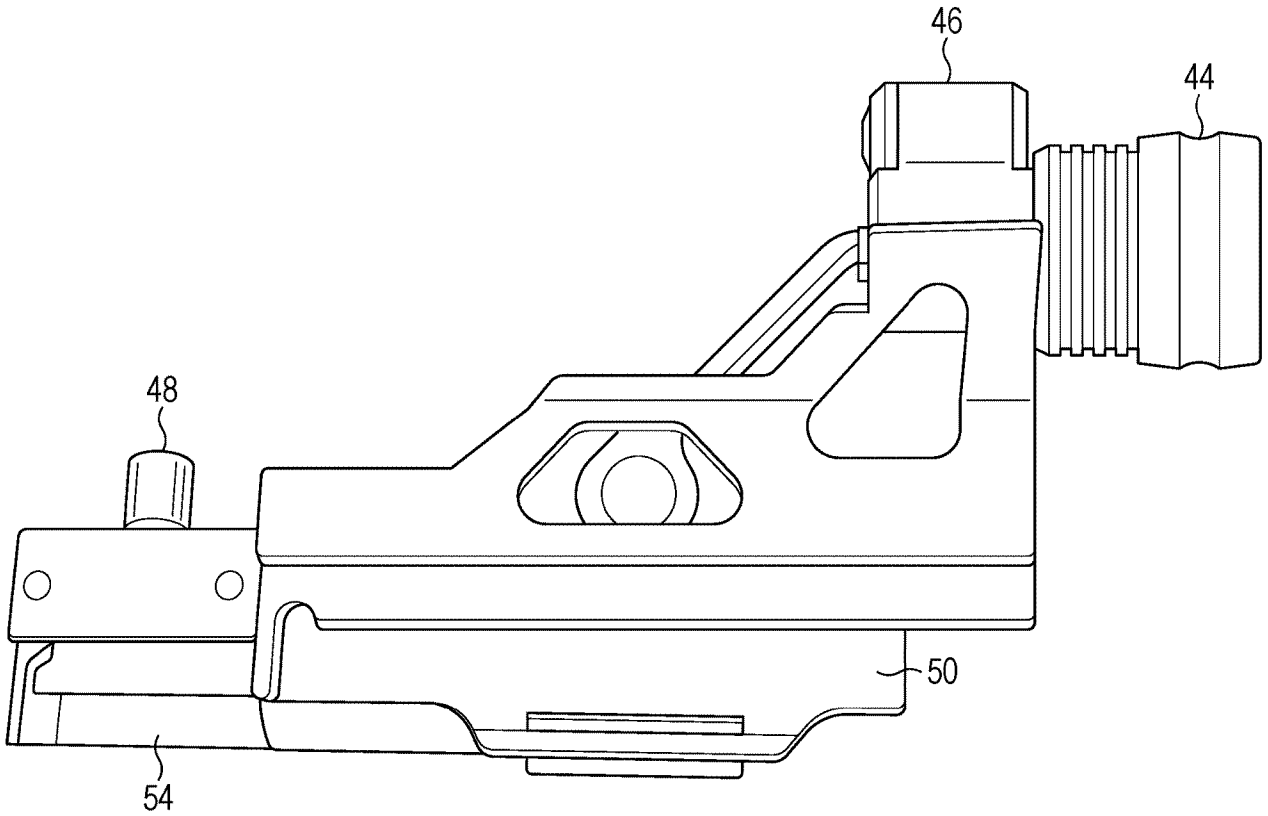
FIG. 4 shows a back-side view of an embodiment of a laser aiming and illumination device.

FIG. 4 shows a back side of an embodiment of a laser aiming and illumination device. The upper connector 54 mates to the lower connector. The recess 50 matches up to the side rail to allow the module to mount to the side rail 32. Set screw or other retention mechanism holds the laser aiming and illumination device on the side rail.

The purpose of the laser aiming and illumination module is to provide laser ranging or laser illumination of a target. The laser source 46 may include multiple lasers, an infrared laser, etc. A non-laser source 44 includes at least one light source such as an incandescent lamp, a halogen lamp, a light emitting diode (LED), and an infrared emitter. The non-laser source, referred to here as a light source with the understanding that lasers generate light as well, may include multiple laser sources. The illumination module may have a mode selector switch to allow the user to select in which mode the illumination module operates, such as pulsed or strobed, steady-state low, or steady-state high.

Figure 5:
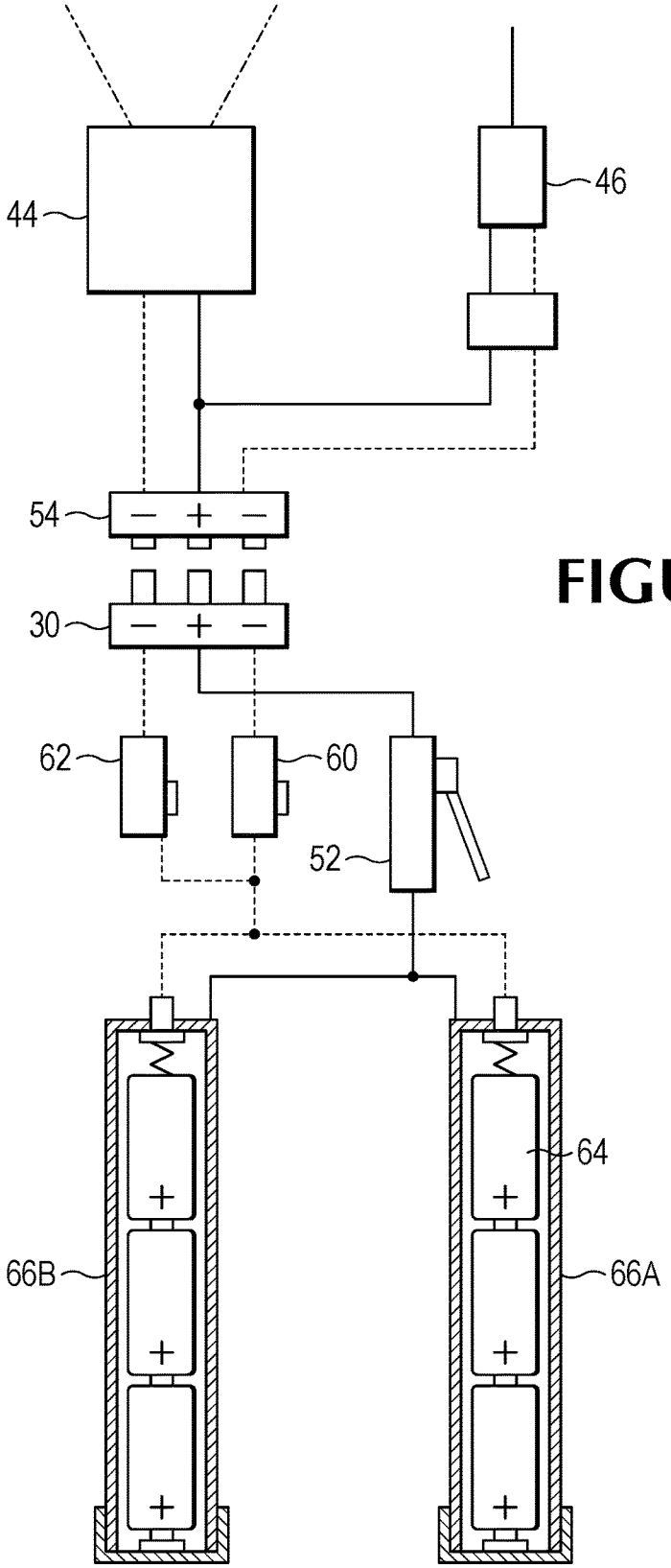
FIG. 5 shows an embodiment of a power source for a laser and illumination device.

The power provided to the laser and non-laser light sources will typically come from a power source consisting of batteries, such as 64 of FIG. 5. The batteries such as 64 may reside in one or more housings such as 66A or 66B. These batteries provide power to the laser aiming and illumination module under the control of the switches 52, 60 and 62. The activation switch 52 activates the laser and non-laser light sources according to the selections made using the laser mode selection switch 60 and the light source mode selection switch 62. These signals transmit to the laser sources 46 and the light sources 44 through the lower connector 30 and upper connector 54.

Figure 6:
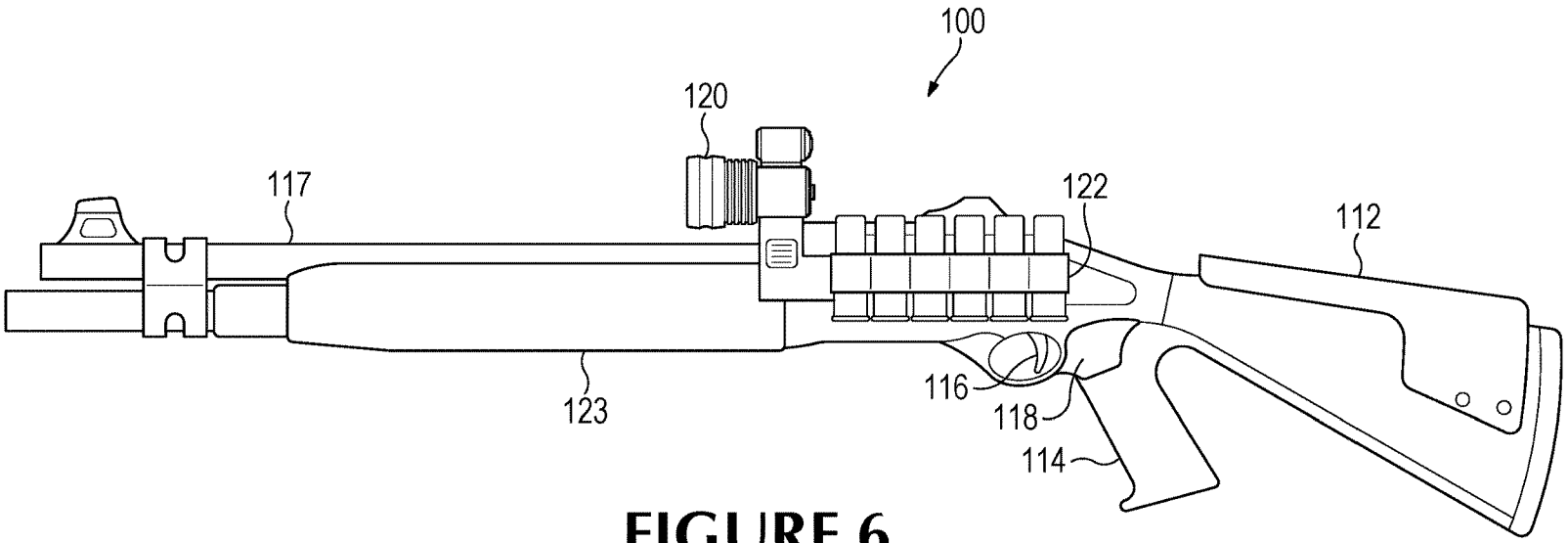
FIG. 6 shows a side view of an embodiment of a firearm with a mounted laser aiming and illumination device having a shell carrier.

FIG. 6 shows a side view of a shotgun style firearms platform 100 having a laser aiming and illumination device with a shell carrier 120. The shotgun in this embodiment has a shoulder stock 112 and a hand grip 114. The batteries or other power source resides in the hand grip 114 and the activation switch 118 resides adjacent the trigger 116 such that the user can trigger the laser aiming and illumination module 120. The laser aiming and illumination module 120 resides behind the active part of the shotgun. The pump handle 123 slides back and forth along the barrel 117 to allow the user to fire the shotgun.

Figure 7:
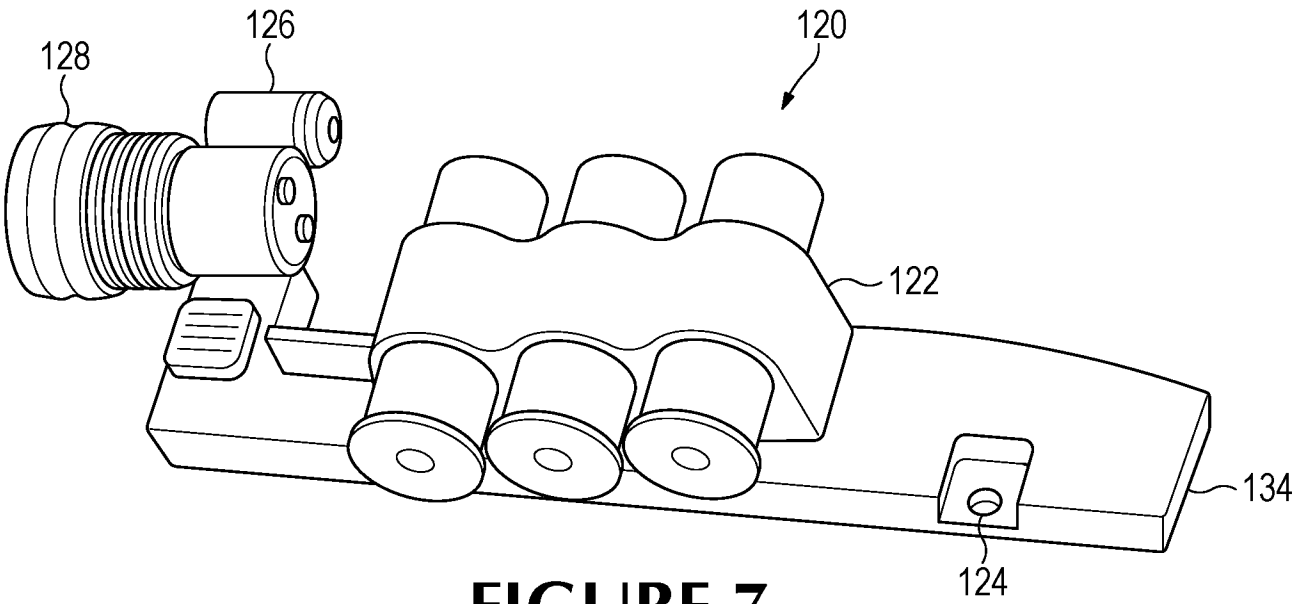
FIG. 7 shows a side view of a laser aiming and illumination module with a shell carrier for a firearm.

FIG. 7 shows a view of the laser aiming and illumination device 120 unmounted from the firearm. In this view, the upper connector 134 connects to the lower connector on the hand grip of the firearm that contains the power source after being replaced by the handgrip of the embodiments here. The shell carrier 122 is optional but is easily adapted for inclusion on the laser and illusion device. The hole 124 allows the laser aiming and illumination device to attach to the side of the firearm using a supplied fastener that replaces the existing factor trigger group pin. The laser source 126 and the light source 128 reside at the end of the device away from the connector 134.

Figure 8:
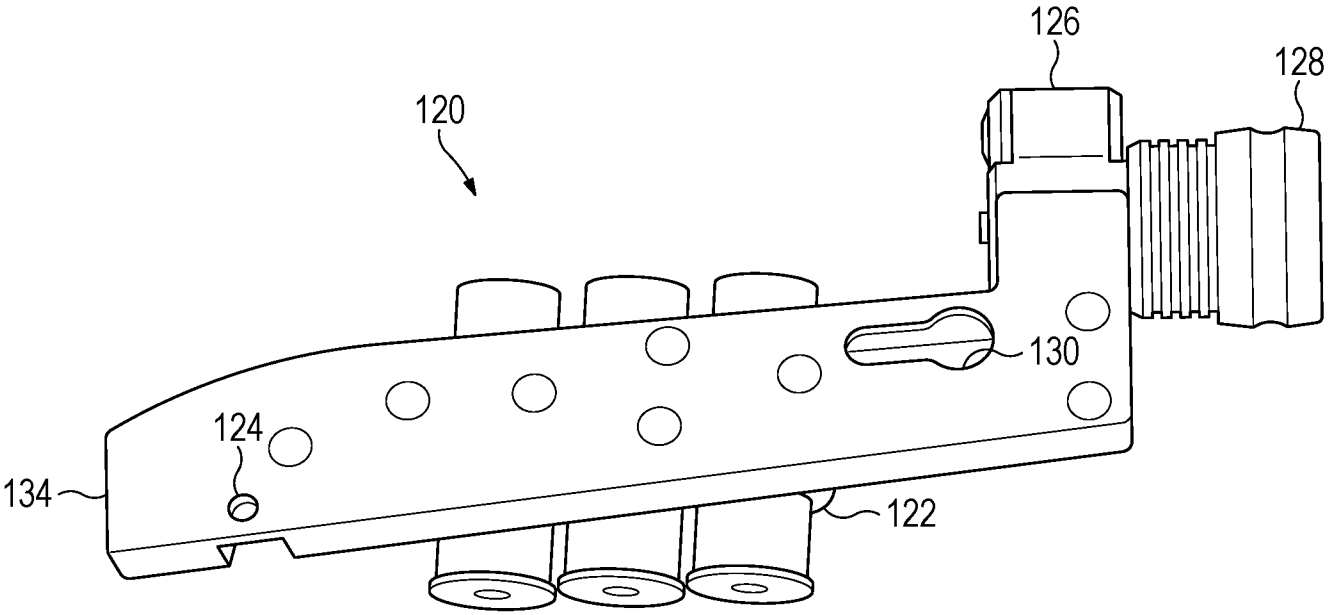
FIG. 8 shows an opposite side view of a laser aiming and illumination module having a shell carrier for a firearm.

FIG. 8 shows a back side of an embodiment of a laser aiming and illumination device. A mounting recess 130 allows the device to mount to the side of the shotgun body. The configuration of this mounting recess allows the device to slide onto the firearm and then slides forward along the recess until it mates with the lower connector, or allows it to be mounted to the hole 124 shown previously.

Figure 9:
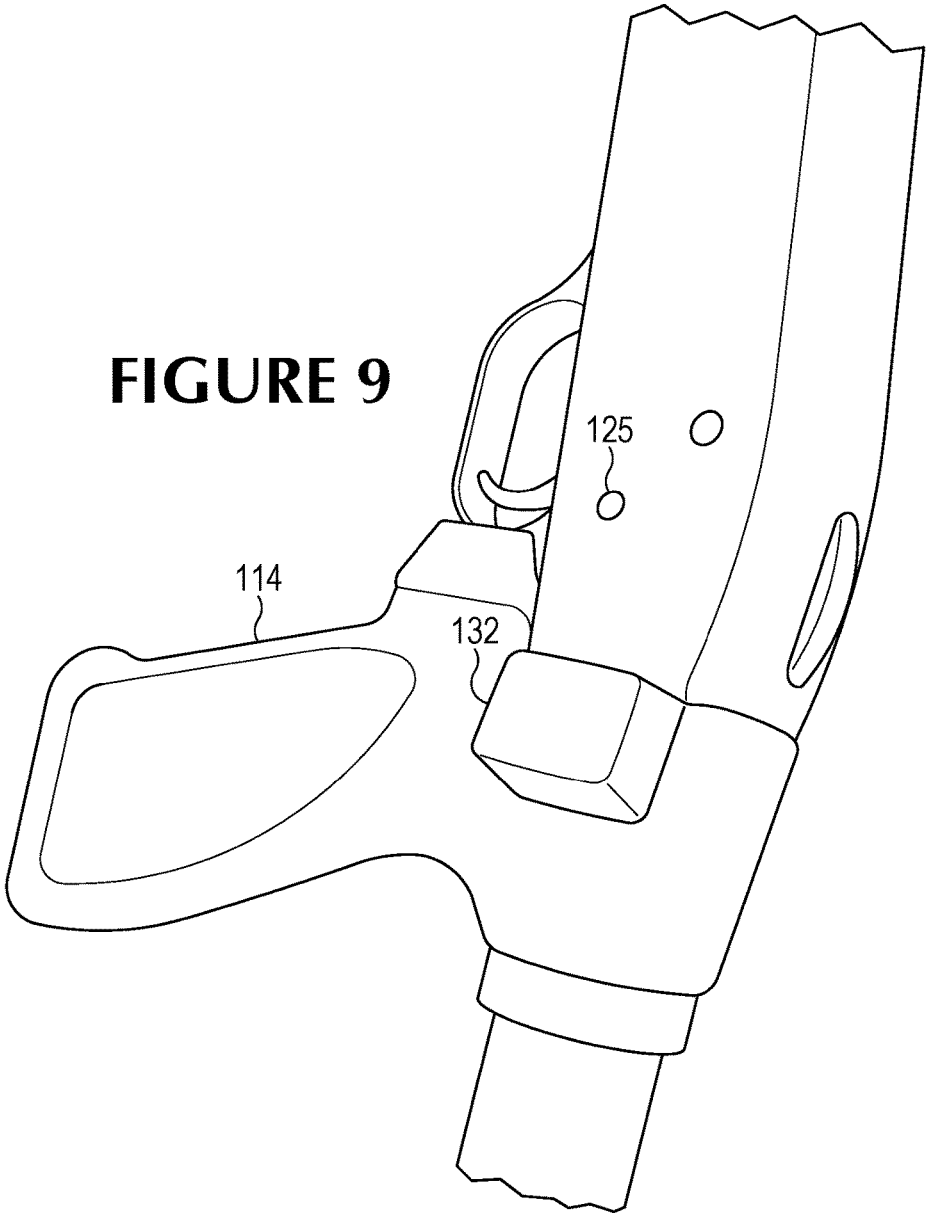
FIG. 9 shows an embodiment of a firearm with a handgrip having a power connector.

FIG. 9 shows the shotgun prior to the mounting of the laser aiming and illumination device. The handgrip 114 has the power source and the connector 132 connects to the upper connector 134 when the device slides into place. The pin 125 connects to the hole 124 on the device.

Figure 10:
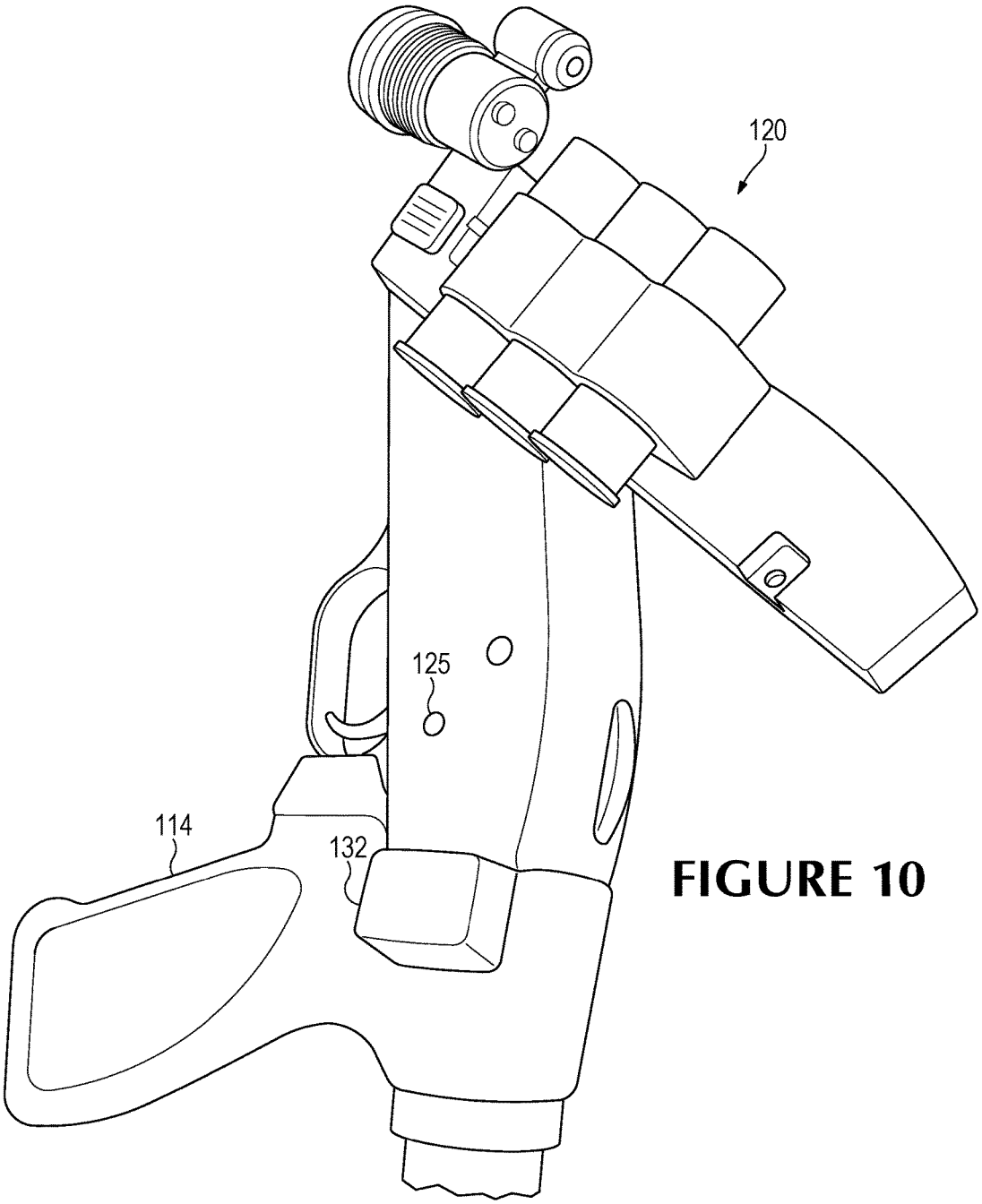
FIG. 10 shows an embodiment of a firearm mounted laser aiming and illumination device having a shell carrier.

FIG. 10 shows the mounting of the laser aiming and illumination device 120. It slides onto the mounting element using the recess shown earlier and then slides down and mates the hole 124 on the device to the hole 125 on the firearm into which a pin can slide and retain the laser aiming and illumination device. This embodiment involves a shotgun that has a shoulder stock and handgrip.

Figure 11:
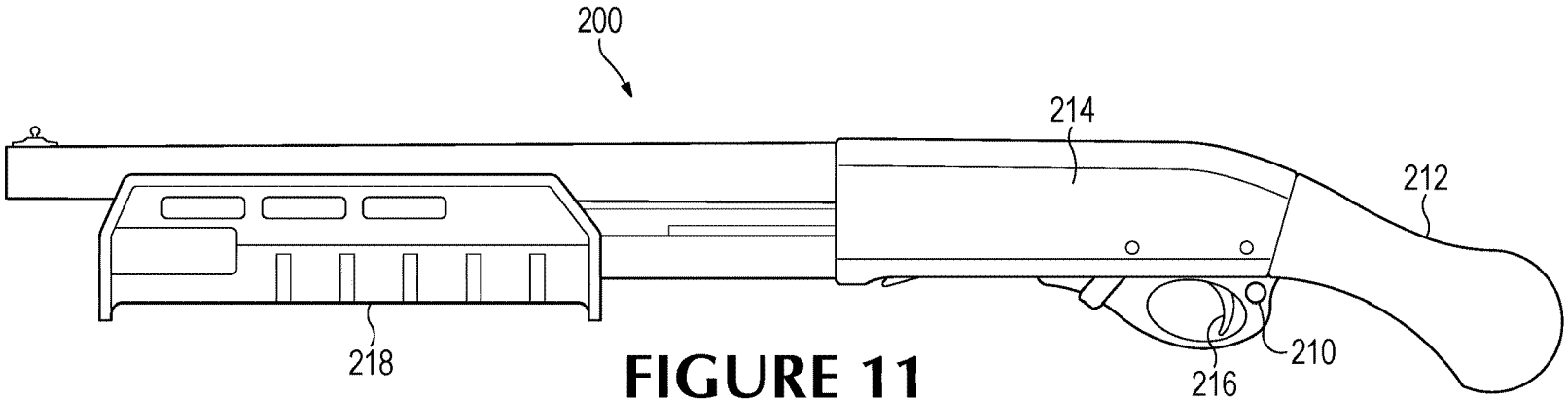
FIG. 11 shows an embodiment of a tactical firearm with no shoulder stock.

The embodiment above involves a shotgun that has a shoulder stock and a handgrip. FIG. 11 shows a different embodiment of a shot shell firearm that is like a shotgun, but does not have a shoulder stock and will be referred to here as a 'tactical.' The firearm 200 has a handgrip 212 having an activation switch 210 adjacent the trigger 216. The firearm 200 has a side surface 214 on a side opposite the ejection port for the shells. As will be shown in further drawings, the activation switch will connect to the power source. Because of the high impact of these types of firearms, the handgrip will typically be filled with a high impact polymer to absorb the shock. Therefore, the handgrip cannot be used for the batteries. The laser aiming and illumination device has a housing that contains both the laser aiming and illumination module and the power source/battery pack.

Figure 12:
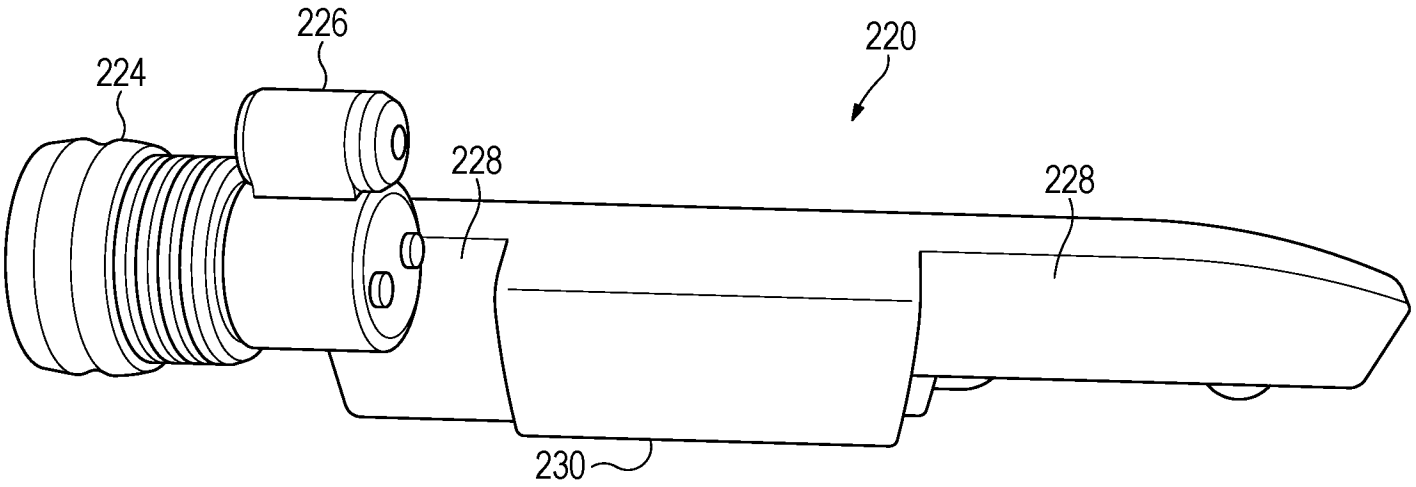
FIG. 12 shows an embodiment of a laser aiming and illumination device with a co-located battery pack.

FIG. 12 shows a laser aiming and illumination device 220 that has a battery pack 230. The portions 228 provides a place for the wiring between the activation switch and the battery pack 230. The laser source 226 and the light source 224 receive their power from the battery pack when activated by the switch.

Figure 13:
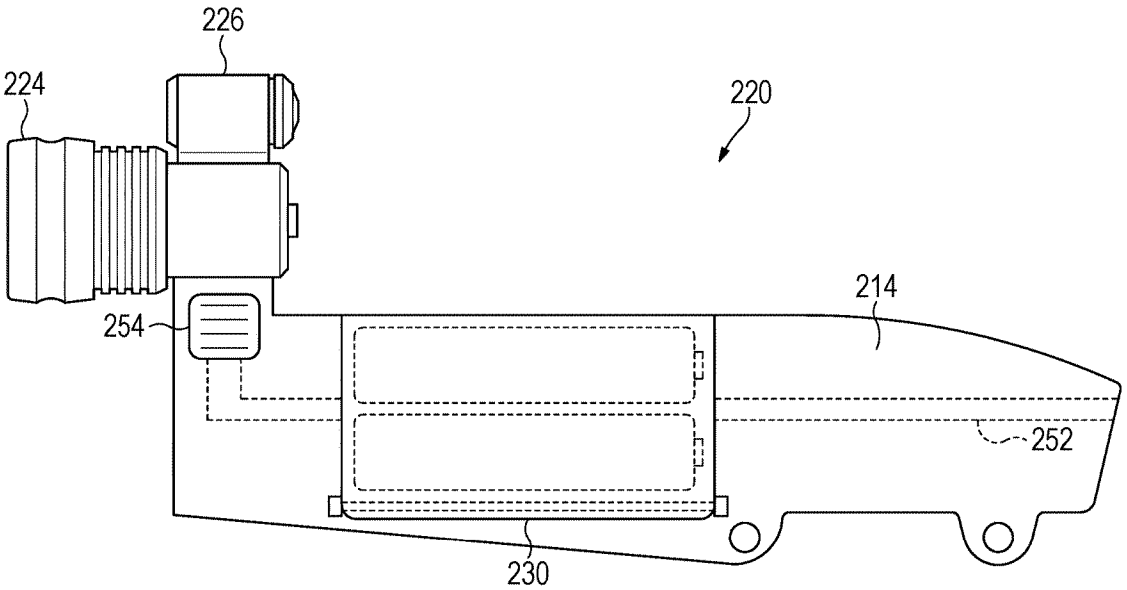
FIG. 13 shows a side view of an embodiment of a wiring diagram of a laser aiming and illumination device with a co-located battery pack.
Figure 14:
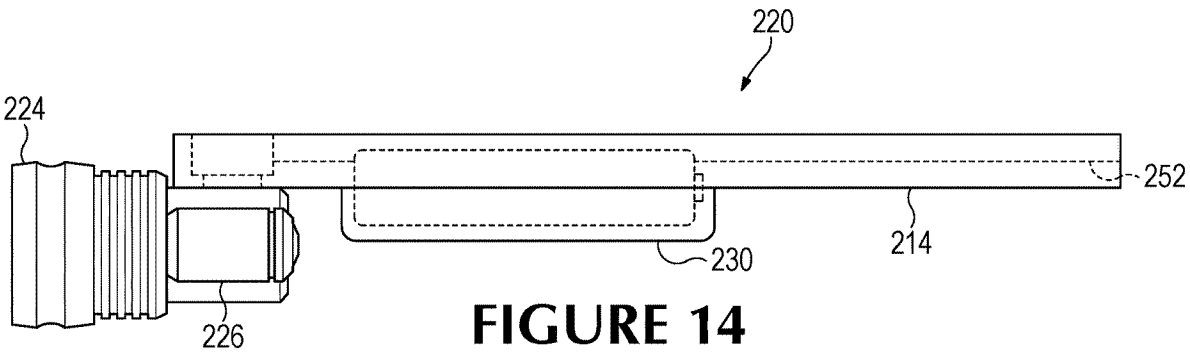
FIG. 14 shows a top view of an embodiment of a wiring diagram of a laser aiming and illumination device with a co-located battery pack.
Figure 15:
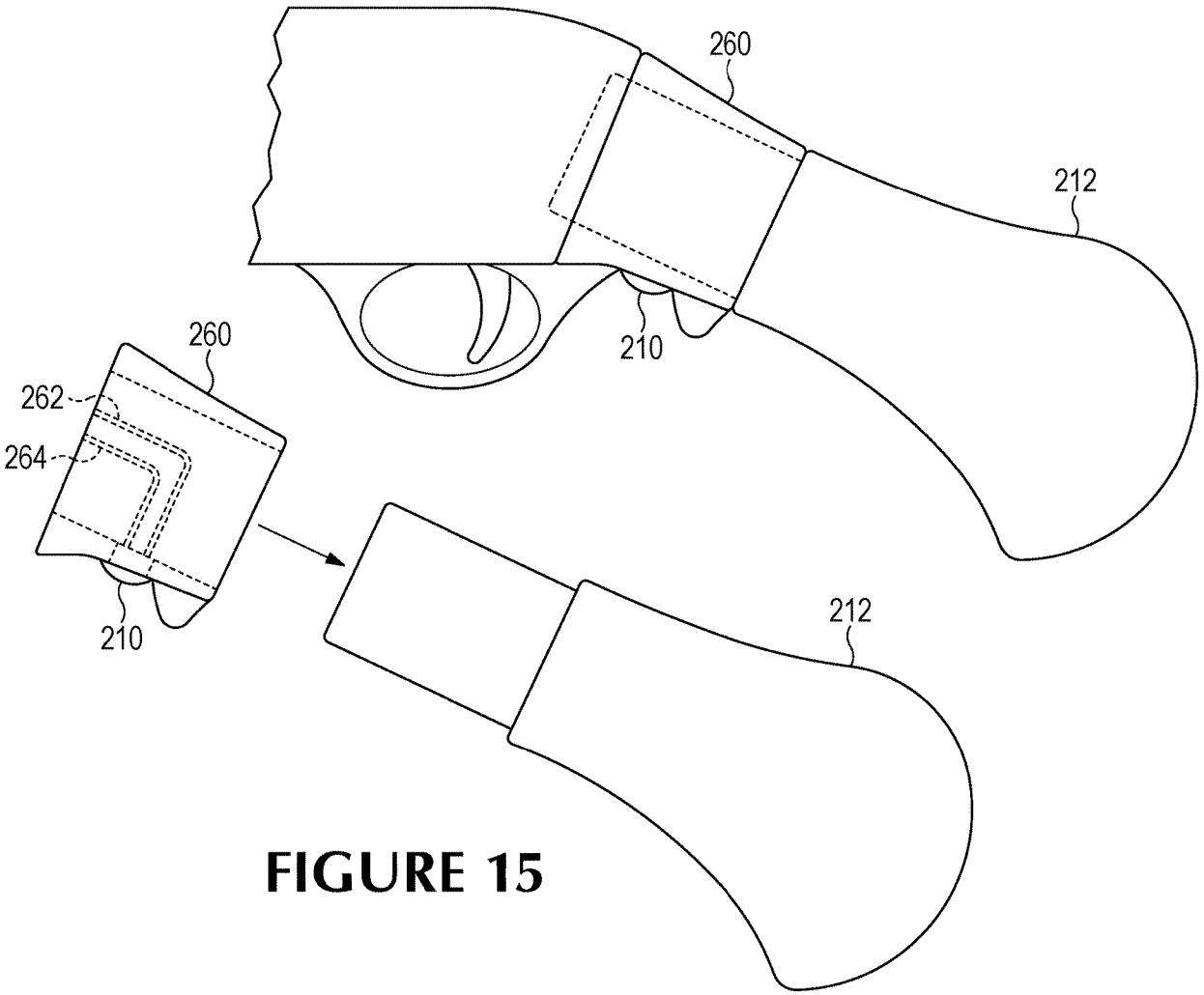
FIG. 15 shows an embodiment of a wiring diagram for an activation button for a laser aiming and illumination device.

FIGS. 13-15 show wiring diagrams for the power routing for the co-located laser aiming and illumination module and battery pack embodiment. The battery pack 230 resides on the side surface of the firearm, with power connection portion 228 between the battery pack 230 and the laser source 226 and the light source 224. In addition, a channel 252 provides an electrical connection between the activation switch and back to the master on/off switch 254. FIG. 14 shows a top view of the laser aiming and illumination device 220.

FIG. 15 shows a diagram of the wiring for the activation switch 210. The dashed box is shown in an exploded view 260. The line 262 provides positive power to the activation switch 210. The line 264 provides the positive power to the master on/off from FIG. 13.

Figure 16:
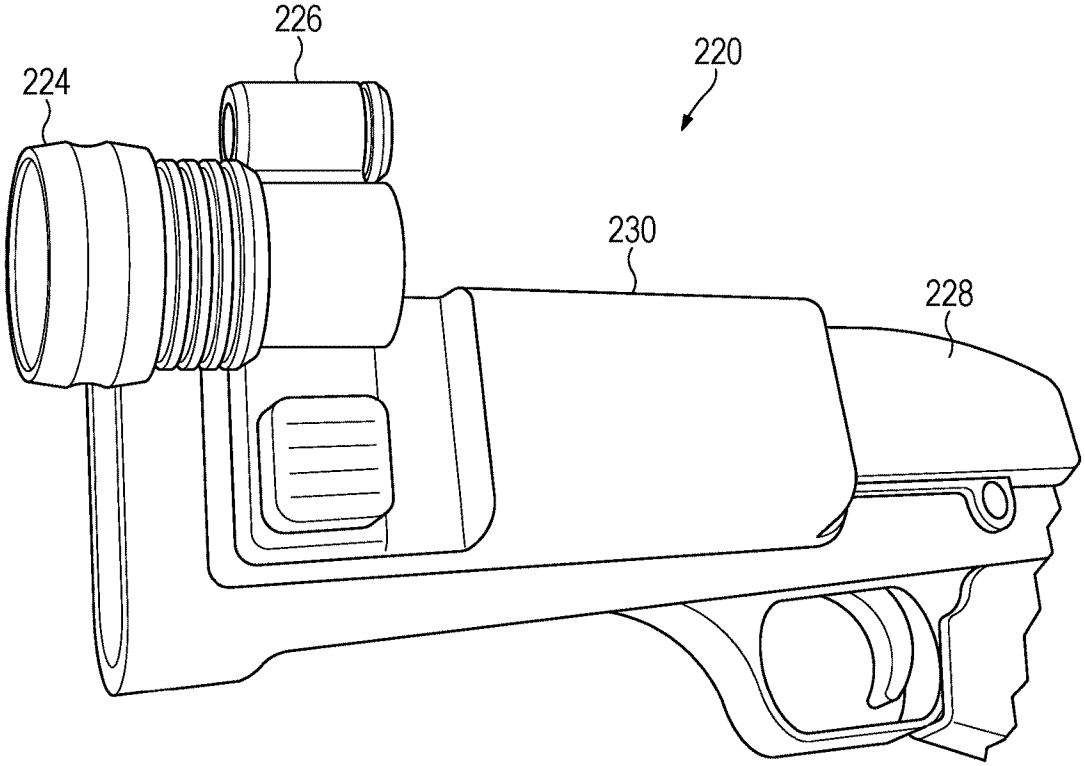
FIG. 16 shows an embodiment of a mounted laser aiming and illumination device with a co-located battery pack.

FIG. 16 shows a laser aiming and illumination module 220 mounted to the side of a firearm side surface. As can be seen from FIG. 16, the portion 228 provides cover and enclosure of the power connections between the battery pack and the activation switch 210.

In this manner, one can provide a laser aiming and illumination device for side mounting to a firearms platform. The firearm platform may include AK style rifles, shotguns with shoulder stocks, and tactical firearms consisting of shot shell firearms that do not have shoulder stocks. The location of the activation switch is adjacent the trigger to allow the user to activate the laser aiming and illumination sources without having to move the hand from the handgrip. The power connections are covered and enclosed by the laser aiming and illumination device to protect them from the external environment. The power connections are either between a handgrip and the laser aiming and illumination module, or between an activation switch and the battery pack that is contained in the same housing as the laser aiming and illumination module.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be used for realizing the invention in diverse forms thereof.

The invention claimed is:

1. A laser aiming and illumination device mountable onto an AK-47 style rifle such that mounting the device onto the AK-47 style rifle does not require permanent alteration of the AK-47 style rifle, the AK-47 style rifle having a trigger, a grip, a lower portion and an upper portion having a side surface, the laser aiming and illumination device, comprising:

an illumination module, including at least one of an illumination source and a laser source mountable to a side rail, the side rail configured to be attached to the AK-47 style rifle adjacent a trigger pin and a hammer pin on the AK-47 rifle;

an illumination mode selector to allow a user to select an operating mode of the at least one of the illumination source and the laser source;

a power module including a power source inside the grip, the power module having a power connection to the illumination module;

an activation switch disposed adjacent the trigger of the AK-47 style rifle and to allow the user to operate the at least one of the illumination source and the laser source in the selected operating mode;

a lower connector attached to the lower portion, the lower connector having a lower electrical connection to the power source inside the grip; and an upper connector positioned on the illumination module to allow the upper connector to releasably mate with the lower connector, the upper connector having an upper electrical connection to the illumination module such that when the lower connector and the upper connector are mated, the power connection between the power module and the illumination module is protected from an external environment.

2. The laser aiming and illumination device of claim 1, wherein the lower connector and the upper connector consist of a pogo pin connector that electrically connect the power module and illumination module in a releasable manner.

3. The laser aiming and illumination device of claim 1, wherein the illumination source is selected from one of an incandescent lamp, a halogen lamp, a light emitting diode, and an infrared emitter.

4. The laser aiming and illumination device of claim 1, wherein the illumination module includes multiple illumination sources.

5. The laser aiming and illumination device of claim 1, wherein the laser source emits infrared light.

6. The laser aiming and illumination device of claim 1, wherein the illumination module includes multiple laser sources.

7. The laser aiming and illumination device of claim 1, wherein the side rail is part of the laser aiming and illumination module.

8. The laser aiming and illumination device of claim 1, wherein the power source includes a plurality of batteries disposed within a power pack.

9. An AK-47 style rifle in combination with the laser aiming and illumination device of claim 1.

* * * * *